United States Patent [19]

Vymazal et al.

[11] 3,994,203

[45] Nov. 30, 1976

[54] ACTUATION MECHANISM FOR AN AUTOMATIC FIRING WEAPON

[75] Inventors: Ivan Vymazal, Geneva; Robert Ramseyer, Versoix, both of Switzerland

[73] Assignee: Werkzeugmaschinenfabrik Oerlikon-Bührle AG, Zurich, Switzerland

[22] Filed: Sept. 3, 1974

[21] Appl. No.: 502,886

[30] Foreign Application Priority Data

Sept. 5, 1973 Canada ..... 12777

[52] U.S. Cl. ..... 89/193

[51] Int. Cl.² ..... F41D 5/10

[58] Field of Search ..... 89/191 R, 193

[56] References Cited

UNITED STATES PATENTS

| | | | |
|---|---|---|---|
| 2,409,225 | 10/1946 | Schaich | 89/193 |
| 2,987,967 | 6/1961 | Wild et al. | 89/193 |
| 2,987,968 | 6/1961 | Janson | 89/193 |

*Primary Examiner*—Stephen C. Bentley
*Attorney, Agent, or Firm*—Werner W. Kleeman

[57] ABSTRACT

An actuation mechanism for an automatic firing weapon, the barrel of which can be connected through the agency of a gas removal channel with a compartment of a cylinder, an actuation piston for the cylinder by means of which there can be maintained open the connection of the compartment with the barrel in a starting position of the actuation piston. The actuation piston can be displaced into a rearward position in the cylinder by means of the gases tapped-off via the gas removal channel, and the compartment during the forward movement of the actuation piston can be closed by such actuation piston prior to reaching the starting position for the purpose of damping the piston movement. The compartment filled with gases is closed in the rearmost position of the actuation piston.

4 Claims, 2 Drawing Figures

ACTUATION MECHANISM FOR AN AUTOMATIC FIRING WEAPON

BACKGROUND OF THE INVENTION

The present invention relates to a new and improved construction of actuation mechanism for an automatic firing weapon.

According to one construction of actuation mechanism which has become known to the art from U.S. Pat. No. 2,800,059, the gases which prevail in the weapon barrel escape through a gas removal channel into a hollow compartment in the actuation piston and flow through a Venturi nozzle into the forward position of a cylinder, the actuation piston thereby being placed into a rearward movement from a starting position against a spring force. As soon as the actuation piston has become somewhat shifted out of its starting position, then the gas removal channel is closed by the actuation piston and in the hollow compartment of the actuation piston and in the cylinder there is closed a compartment filled with the tapped-off gases. As soon as the actuation piston has arrived at its rearmost position the gas removal channel is opened by the actuation piston and the major portion of the gases can again escape out of the cylinder via the gas removal channel into the weapon barrel. The spring force then again propels the actuation piston towards the front, whereby the gas removal channel is again closed and there again is present a closed compartment in the hollow compartment of the actuation piston and in the cylinder, in which there are enclosed the remainder of the gases and form a gas cushion for damping the forward movement of the actuation piston. The remainder of the gases only then can escape via the gas removal channel after again reaching the starting position. It is a drawback of this arrangement that for damping the forward movement there is only employed a small proportion of the tapped-off gases, whereas the major portion of such gases can escape without being used in the rearmost position of the actuation piston.

SUMMARY OF THE INVENTION

Hence, it is a primary object of the present invention to provide an improved construction of actuation mechanism for an automatic firing weapon which is not associated with the aforementioned drawbacks and limitations of the prior art proposals.

Another and more specific object of the present invention aims at the provision of an apparatus wherein it is possible to utilize the entire tapped-off volume of gas for damping the forward movement of the actuation piston.

According to the invention there is provided an improved construction of actuation mechanism for an automatic firing weapon, the barrel of which can be connected through the agency of a gas removal channel with a compartment or chamber of a cylinder equipped with an actuation piston and by means of which there can be maintained open the connection of the compartment with the barrel in a starting position of the actuation piston. The actuation piston is displaceable into a rear position in the cylinder by means of the gases tapped-off via the gas removal channel, this compartment being closed during the forward movement of the actuation piston by such actuation piston prior to reaching the starting position for the purpose of damping the piston movement. The invention contemplates closing the compartment filled with the gases in the rearmost position of the actuation piston.

BRIEF DESCRIPTION OF THE DRAWING

The invention will be better understood and objects other than those set forth above, will become apparent when consideration is given to the following detailed description thereof. Such description makes reference to the annexed drawing wherein.

DETAILED DESCRIPTION OF THE PREFERRED EMBODIMENTS

Figure 1:
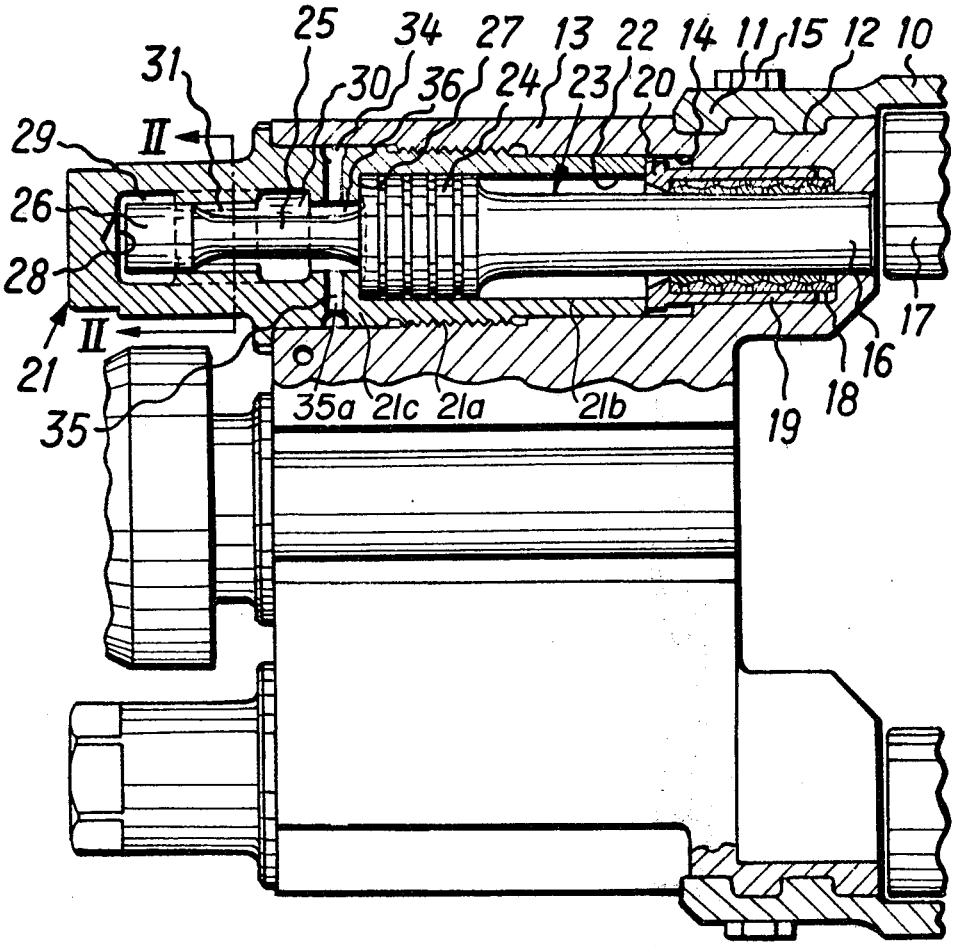
FIG. 1 is a partial sectional view through a portion of an automatic firing weapon designed according to the present invention.
Figure 2:
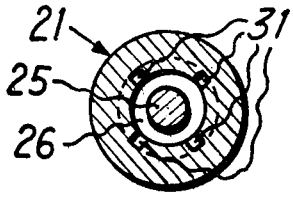
FIG. 2 is a cross-sectional view of the arrangement shown in FIG. 1, taken substantially along the line II—II thereof.

Describing now the drawing, according to the showing of FIG. 1 a weapon housing 10 engages by means of webs 11 or the like in appropriately configured grooves 12 provided at a piston housing 13 and is secured thereat via screws 15 or equivalent structure. The piston housing 13 possesses two bores 14 which are stepped in diameter and arranged substantially symmetrically with respect to the central plane of such piston housing, and wherein in the sectional showing of FIG. 1 only one such bore is visible. A piston rod 16 extends through the bore 14 rearwardly out of the piston housing 13. The piston rod 16 bears at the rear against a slide 17 which serves to drive components of the weapon which have not been particularly illustrated since the same do not constitute subject matter of this development and are unnecessary for understanding the basic concepts of the invention. The piston rod 16 is surrounded by a package of annular or ring-shaped springs 18 serving as a shock absorber or damping device and which bears against the rearmost bore shoulder. A sleeve 19 is pushed over the package of ring-shaped or annular springs 18. The sleeve 19 bears towards the rear by means of a flange collar 20 at the package of annular springs 18 and is displaceable towards the rear in the bore 14. The flange collar 20 of the sleeve 19 bears towards the front against an insert element 21. The insert element or piece 21 is threaded from the front by means of threading **21*a* into the stepped bore 14 of the piston housing 13 and in turn possesses a blindhole bore 22 which is formed from the rear and is stepped in diameter. The insert element 21 forms a cylinder 21*b* for an actuation piston 23, the piston rod 16 of which transforms at the front into a piston body or piston 24. This piston body 24 in turn transforms at the front into a further piston rod 25 which, in turn, possesses a piston head 26 at its front end. The piston body 24, in its front terminal position, impacts against a bore shoulder or step 27 of the stepped bore 22. The piston head 26 in the terminal position possesses a spacing from an end wall 28 of the cylinder 21. In the forward terminal position of the actuation piston 23 the piston head 26 is surrounded by an annular compartment 29 which has been machined or otherwise cut-in or formed at the cylinder wall. A further annular compartment 30 is machined at the cylinder wall between the piston body 24 and the piston head 26 in this position of the actuation piston 23. Both annular compartments 29, 30** are connected with one another by means of axially parallel throttle channels 31 which are machined in the cylinder wall, as the same is best recognized by referring to FIG. 2.

The gas removal channel or channel means 35, which is in flow communication in a not particularly illustrated manner with the weapon barrel, opens between the bore shoulder 27 and the annular compartment 30 along the path of the piston head 26. The location of the opening or mouth 35*a* of the gas removal channel 35 in the cylinder is chosen such that the piston head 26, upon impact of the piston body 24 against the sleeve 19, covers the bores defining the gas removal channel or channel means 35.

Having now had the benefit of the preceding discussion of the construction of the actuation mechanism its mode of operation will be considered and is as follows:

Upon firing a projectile the propellent gases which propel the same flow out of the weapon barrel through the gas removal channel 35 into the interior of the cylinder 21. At that location the propellent gases arrive both in front of the piston body 24 and behind the piston head 26 and furthermore via the throttle channels 31 in front of the piston head 26. The actuation piston 23 is thus driven towards the rear until it impacts against the sleeve 19 and is braked by the package of annular or ring-shaped springs 18. In this position, which constitutes its rear reversal position, the piston head 26 of the actuation piston 23 covers the gas removal channel or channel means 35 which opens in the cylinder wall 21*c*. As a result the propellent charge gases remain enclosed in the cylinder 21 and the gas pressure cannot further diminish if the actuation piston remains in its rear terminal position, whereas the slide 17 owing to its relatively great mass continues the rearward movement and finally is again propelled towards the front by means of a restoring spring. During its forward movement the slide 17 again impacts against the actuation piston 23. The actuation piston 23 must be displaced against the gas pressure remaining in the cylinder 21, with the result that there is realized a very good damping of the forward movement. Without closing the gas removal channel, the gas pressure in the cylinder 21, in the time between release of the slide 17 from the piston rod 16 and the re-arrival thereat, would drop from the mentioned pressure practically to 1 atmosphere pressure.

While there is shown and described present preferred embodiments of the invention, it is to be distinctly understood that the invention is not limited thereto, but may be otherwise variously embodied and practiced within the scope of the following claims.

What is claimed is:

1. An actuation mechanism for an automatic firing weapon possessing a barrel which is connectable via a gas removal channel with a compartment of a cylinder, said cylinder being equipped with an actuation piston by means of which there is maintained open the connection of the compartment with the barrel in a starting position of the actuation piston, said actuation piston being displaceable into a rearward position in the cylinder by means of gases tapped-off via the gas removal channel, the compartment being closable during the forward movement of the actuation piston by the actuation piston prior to reaching the starting position for the purpose of damping the piston movement, the improvement comprising: said actuation piston defining means for closing the compartment filled with gas in the rearmost position of the actuation piston, the actuation piston possesses a piston body and a piston head having reduced diameter, a piston rod for connecting the piston body and piston head with one another, and wherein the gas removal channel in the rearmost position of the actuation piston is closed by the reduced diameter-piston head.

2. The actuation mechanism as defined in claim 1, further including a first annular compartment provided in a wall of said cylinder at the region of a forward terminal position of the piston head and a second annular compartment provided in the wall of the cylinder between the piston head and the piston body in their forward terminal position, and substantially axially parallel channels provided in the wall of the cylinder between both annular compartments.

3. The actuation mechanism as defined in claim 2, wherein the gas removal channel has a mouth portion opening into the cylinder and located between the second annular compartment and a bore shoulder serving as a stop for the piston body.

4. An actuation mechanism for an automatic firing weapon possessing a barrel which is connectable via a gas removal channel with a compartment of a cylinder, said cylinder being equipped with an actuation piston by means of which there is maintained open the connection of the compartment with the barrel in a starting position of the actuation piston, said actuation piston being displaceable into a rearward position in the cylinder by means of gases tapped-off via the gas removal channel, the compartment being closable during the forward movement of the actuation piston by the actuation piston prior to reaching the starting position for the purpose of damping the piston movement, the improvement comprising: said actuation piston defining means for closing the compartment filled with gas in a rearmost position of the actuation piston, a first annular compartment provided in a wall of said cylinder at the region of a forward terminal position of the actuation piston and channel means for communicating said first annular compartment with said second annular compartment at the region of a rearward terminal position of the actuation piston and means providing communication between said first and second annular compartments.

* * * * *